US011702788B2

(12) United States Patent
Huang et al.

(10) Patent No.: US 11,702,788 B2
(45) Date of Patent: Jul. 18, 2023

(54) DISPENSER ASSEMBLY AND WASHING MACHINE

(71) Applicants: QINGDAO HAIER DRUM WASHING MACHINE CO., LTD., Shandong (CN); HAIER SMART HOME CO., LTD., Shandong (CN)

(72) Inventors: Tao Huang, Shandong (CN); Haiyong Sheng, Shandong (CN); Huacheng Zhang, Shandong (CN)

(73) Assignees: CHONGQING HAIER ROLLER WASHING MACHINE CO., LTD., Chongqing (CN); HAIER SMART HOME CO., LTD., Qingdao (CN)

( * ) Notice: Subject to any disclaimer, the term of this patent is extended or adjusted under 35 U.S.C. 154(b) by 391 days.

(21) Appl. No.: 16/960,517

(22) PCT Filed: Jan. 8, 2019

(86) PCT No.: PCT/CN2019/070813
§ 371 (c)(1),
(2) Date: Jul. 7, 2020

(87) PCT Pub. No.: WO2019/134709
PCT Pub. Date: Jul. 11, 2019

(65) Prior Publication Data

US 2020/0370227 A1 Nov. 26, 2020

(30) Foreign Application Priority Data

Jan. 8, 2018 (CN) ..... 201810015391.2

(51) Int. Cl.
*D06F 39/02* (2006.01)

(52) U.S. Cl.
CPC ..... *D06F 39/022* (2013.01)

(58) Field of Classification Search
CPC ..... D06F 39/022
See application file for complete search history.

(56) References Cited

U.S. PATENT DOCUMENTS

| | | | |
|---|---|---|---|
| 9,963,819 | B2 | 5/2018 | Leibman et al. |
| 2016/0237612 | A1 | 8/2016 | Ghosh et al. |

FOREIGN PATENT DOCUMENTS

| | | | |
|---|---|---|---|
| CN | 101177902 | A | 5/2008 |
| CN | 101177896 | B | 6/2011 |
| CN | 108103734 | A | 6/2018 |
| CN | 207933738 | U | 10/2018 |
| DE | 19728105 | A1 | 1/1999 |
| EP | 2363057 | A1 | 9/2011 |
| EP | 2374926 | A2 | 10/2011 |

(Continued)

OTHER PUBLICATIONS

International Search Report for PCT/CN2019/070813 dated Apr. 17, 2019 in English Translation.

(Continued)

*Primary Examiner* — Jason Y Ko
(74) *Attorney, Agent, or Firm* — ArentFox Schiff LLP

(57) ABSTRACT

Provided is a dispenser assembly. The dispenser assembly includes a handle; a waterproof box, where a gap is disposed between the waterproof box and a dispenser; and a first block rib that is disposed inside the waterproof box and at one end of the waterproof box adjacent to the handle of the dispenser, where the first block rib is configured to prevent liquid from overflowing from the gap.

9 Claims, 2 Drawing Sheets

(56) References Cited

FOREIGN PATENT DOCUMENTS

| | | | |
|---|---|---|---|
| EP | 2471991 | A2 | 7/2012 |
| WO | 2009142455 | A2 | 11/2009 |
| WO | 2013033800 | A1 | 3/2013 |
| WO | 2017114272 | A1 | 7/2017 |

OTHER PUBLICATIONS

European Search Report for EP Application 19736070.4 dated Jul. 28, 2021.

DISPENSER ASSEMBLY AND WASHING MACHINE

CROSS-REFERENCE TO RELATED APPLICATIONS

This is a national phase entry of PCT/CN2019/070813 filed Jan. 8, 2019, which claims priority to Chinese patent application No. 201810015391.2 filed Jan. 8, 2018, the entire contents of each of which is hereby incorporated by reference in its entirety.

TECHNICAL FIELD

The present disclosure relates to the technical field of washing machine accessories and, for example, to a dispenser assembly and a washing machine.

BACKGROUND

When a dispenser of a washing machine, especially a drum washing machine, is pulled out of a machine body, residual liquid flows out together with the dispenser. Mixed liquor of additives brings inconvenience to a user no matter dripping onto the user or flowing onto the washing machine or the ground. Therefore, the dispenser usually needs to be used by cooperating with a waterproof box.

As shown in FIG. 1, a waterproof box 100 in the related art is stuck at a lower end of a dispenser 101, and one side of the waterproof box 100 is disposed inside a washing machine. Through the waterproof box 100, residual liquid in the dispenser 101 may be guided into the washing machine, thereby avoiding the liquid flowing out. During the operation of the dispenser 101, since the waterproof box 100 is mostly made of a plastic material, the hydrophilicity of the plastic materials causes the residual liquid that flows onto the waterproof box 100 to spread along the waterproof box 100. As more and more water flows onto the waterproof box 100, the water overflows along a gap (position A shown in FIG. 1) between the waterproof box 100 and the dispenser 101, and then flows out of the washing machine along a handle, which is still inconvenient for the user.

SUMMARY

The present disclosure provides a dispenser assembly and a washing machine to solve the problem in the related art that water overflows from a gap between a waterproof box and a dispenser during the operation of the dispenser.

In an embodiment, provided is a dispenser assembly. The dispenser assembly includes a dispenser that includes a handle; a waterproof box, where a gap is disposed between the waterproof box and the dispenser; and a first block rib that is disposed inside the waterproof box and at one end of the waterproof box adjacent to the handle of the dispenser, where the first block rib is configured to prevent liquid from overflowing from the gap.

In an embodiment, provided is a washing machine. The washing machine includes the preceding dispenser assembly.

1—dispenser; 2—waterproof box; 3—first block rib; 4—water collection cavity; 5—second block rib; 11—handle; 12—siphon inlet; 31—water leak; 100—waterproof box; 101—dispenser.

DETAILED DESCRIPTION

Figure 1:
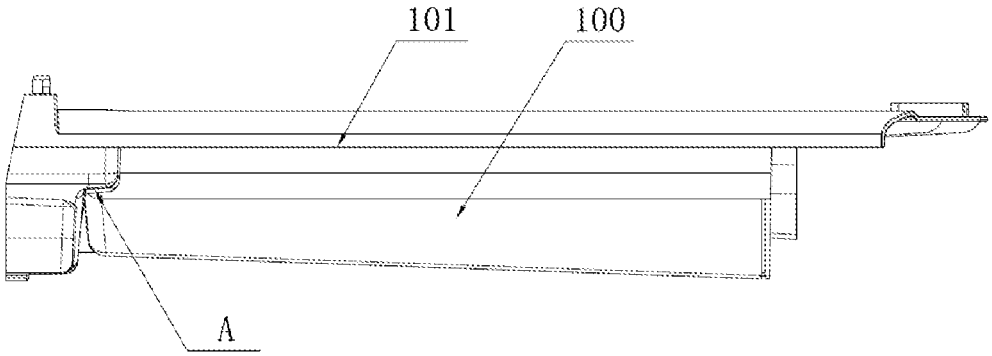
FIG. 1 is a structural diagram illustrating a dispenser assembly in the related art.
Figure 2:
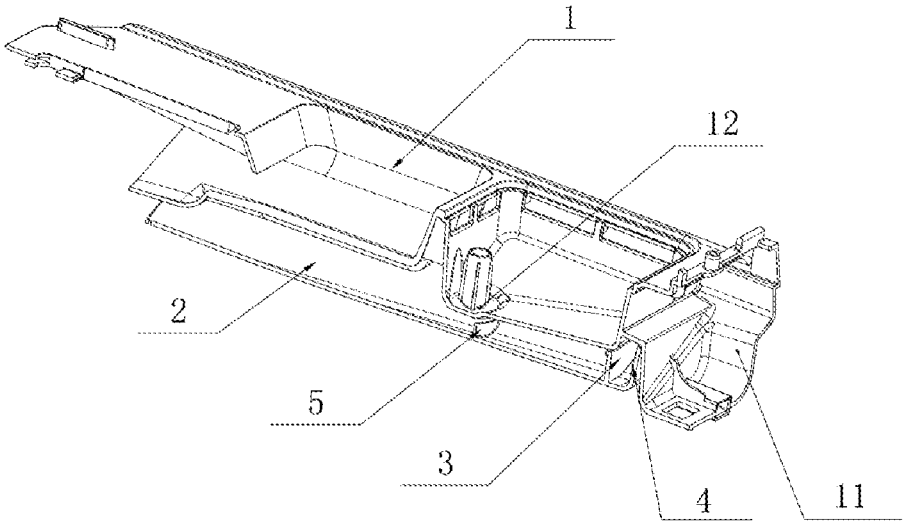
FIG. 2 is a sectional view illustrating a dispenser assembly according to an embodiment provided by the present disclosure.
Figure 3:
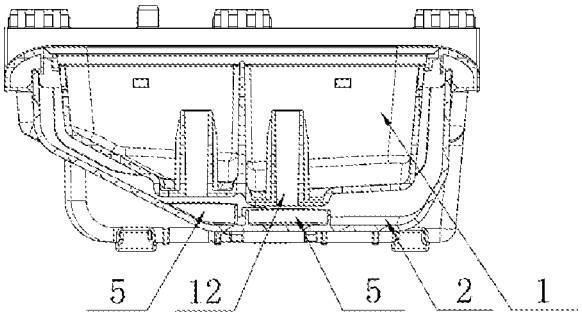
FIG. 3 is another sectional view illustrating the dispenser assembly according to an embodiment provided by the present disclosure.
Figure 4:
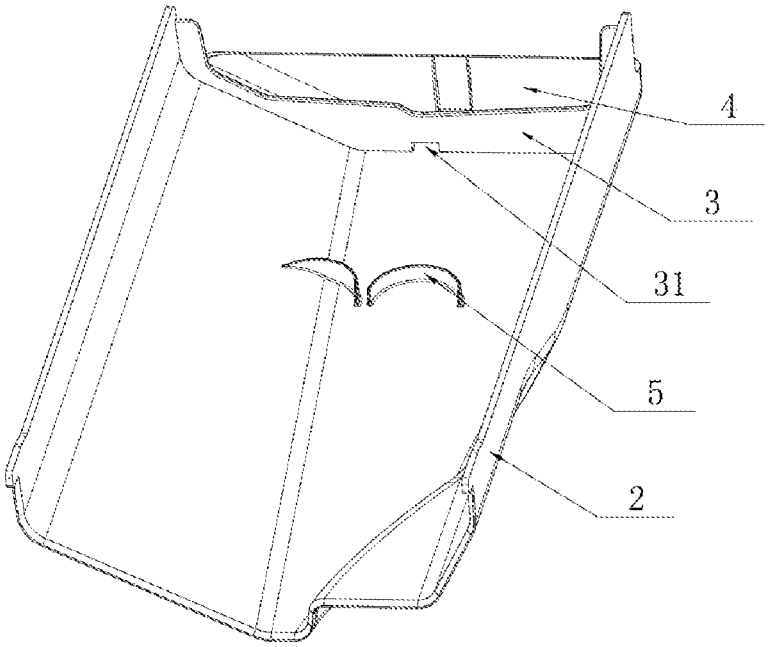
FIG. 4 is a structural diagram illustrating a waterproof box of a dispenser assembly according to an embodiment provided by the present disclosure.

This embodiment provides a dispenser assembly. As shown in FIGS. 2 and 3, the dispenser assembly includes a dispenser 1 and a waterproof box 2 located below the dispenser 1, and a first block rib 3 is disposed inside the dispenser 1 and at one end of the waterproof box 2 adjacent to a handle 11 of the dispenser 1. As shown in FIG. 4, a first side of the first block rib 3 is connected to a first sidewall of the waterproof box 2, a second side of the first block rib 3 is connected to a second sidewall of the waterproof box 2, and a bottom of the first block rib 3 is connected to a bottom of the waterproof box 2. In an embodiment, the first block rib 3 and the waterproof box 2 may be integrally formed by injection molding.

When water continuously enters the dispenser 1, liquid flows into the waterproof box 2 and flat spreads along the waterproof box 2. That is, a large amount of liquid flows back. In this case, the first block rib 3 can block the liquid backflow and prevent the liquid from overflowing from a gap between the waterproof box 2 and the dispenser 1, thereby improving the user experience. Moreover, the first block rib 3 can offset the energy of the liquid backflow so that the liquid automatically flows back from the first block rib 3 and into the washing machine through the waterproof box 2.

In this embodiment, if the energy of the liquid backflow is relatively large, part of the liquid may pass over the first block rib 3. In this case, it is still possible for the liquid to overflow from the gap between the waterproof box 2 and the dispenser 1. To avoid this situation, referring to FIG. 4, a water collection cavity 4 is formed between the first block rib 3 and the one end of the waterproof box 2 adjacent to the handle 11 of the dispenser 1, and the first block rib 3 is provided with a water leak 31 communicated with the water collection cavity 4, where a position of the water leak 31 is lower than a position of the gap. When a small amount of liquid passes over the first block rib 3 and enters the water collection cavity 4, the small amount of liquid can flow out through the water leak 31 and finally flows into the washing machine through the waterproof box 2, which may avoid the situation where the liquid remains in the waterproof box 2 and after too much liquid is accumulated, the accumulated liquid overflows from the gap between the waterproof box 2 and the dispenser 1.

In this embodiment, the water leak 31 is disposed at a bottom of a lower end of the first block rib 3, the water leak 31 is an opening structure, and an opening side of the water leak 31 is configured to face to the bottom of the waterproof box 2. The water leak 31 is disposed at the bottom of the lower end of the first block rib 3 and the water leak 31 is an opening structure, such that the water in the water collection cavity 4 may flow out completely and finally flow into the washing machine. In this embodiment, one water leak 31 may be provided and disposed at a middle of the bottom of the lower end of the first block rib 3, or multiple water leaks 31 may be provided and disposed at the bottom of the lower end of the first block rib 3 at equal intervals.

In this embodiment, an upper end surface of the first block rib 3 is in contact with a lower surface of the dispenser 1. That is, a shape and a structure of the upper end surface of the first block rib 3 are fitted with a shape and a structure of the lower surface of the dispenser 1. The fit between the first block rib 3 and the lower surface of the dispenser 1 further prevents the liquid from flowing into the water collection cavity 4.

In view of higher requirements of a user for clothing additives, during the cloth washing in the related art, it is necessary to add not only laundry detergent or washing powder, but also additives such as softener and disinfectant, so the dispenser 1 is provided with multiple siphon structures for conveying liquid such as different additives. As regards the dispenser 1 having the siphon structures, in this embodiment, the waterproof box 2 is provided with a second rib 5 configured to face to a siphon inlet 12 of the dispenser 1. The second rib 5 can prevent the liquid that falls down from the siphon inlet 12 of the dispenser 1 from splashing around. That is, when the liquid falls down from the siphon inlet 12 of the dispenser 1, the second block rib 5 can block the liquid and reduce kinetic energy of the liquid so that the liquid can flow into the washing machine along the bottom of waterproof box 2. This can reduce or even avoid the situation of splashing around, and further reduce the liquid that flows back to the first block rib 3, thus preventing the liquid from overflowing from the gap between the waterproof box 2 and the dispenser 1. In this embodiment, the number of second block ribs 5 is the same as the number of siphon inlets 12.

In this embodiment, the second block rib 5 is an arc-shaped structure, and the arc-shaped structure is convex toward the first block rib 3. In one aspect, a concave side of the arc-shaped structure can prevent the liquid that falls down from the siphon inlet 12 of the dispenser 1 from splashing around. In another aspect, the convex side of the arc-shaped structure can also guide the liquid blocked by the first stop rib 3 and prevent the liquid from remaining in the waterproof box 2.

Figure 5:
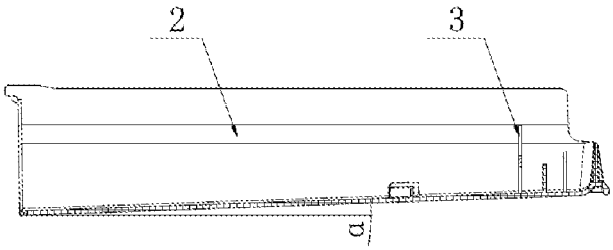
FIG. 5 is a sectional view illustrating a waterproof box of a dispenser assembly according to an embodiment provided by the present disclosure.

In this embodiment, referring to FIG. 5, the bottom of the waterproof box 2 is obliquely disposed relative to a horizontal plane, and a first end of the bottom of the waterproof box 2 adjacent to the handle 11 is higher than a second end of the bottom of the waterproof box 2 facing away from the handle 11. Through such a structural configuration, the liquid in the waterproof box 2 can completely flow into the washing machine along the oblique plane instead of remaining in the waterproof box 2. In an embodiment, an included angle between the horizontal plane and the bottom of the waterproof box 2 is within a range from 1° to 2.5°. Such an angle can enable the liquid in the waterproof box 2 to flow into the washing machine along the waterproof box 2 on the premise that the waterproof box 2 can be pulled out (that is, the included angle cannot be too large).

This embodiment further provides a washing machine. The washing machine includes the preceding dispenser assembly. The dispenser assembly can effectively prevent liquid from overflowing from a gap between a waterproof box 2 and a dispenser 1, thereby improving the user experience.

What is claimed is:

1. A dispenser assembly, comprising:

a dispenser, which comprises a handle;

a waterproof box, wherein a gap is disposed between the waterproof box and the dispenser; and a first block rib, which is disposed inside the waterproof box and at one end of the waterproof box adjacent to the handle, wherein the first block rib is configured to prevent liquid from overflowing from the gap.

2. The dispenser assembly according to claim 1, wherein the waterproof box comprises a water collection cavity, the water collection cavity is formed between the first block rib and the one end of the waterproof box adjacent to the handle, and the first block rib is provided with a water leak, wherein a position of the water leak is lower than a position of the gap.

3. The dispenser assembly according to claim 2, wherein the water leak is disposed at a bottom of a lower end of the first block rib.

4. The dispenser assembly according to claim 2, wherein the water leak is an opening structure, the opening structure comprises an opening side, and the opening side is configured to face to a bottom of the waterproof box.

5. The dispenser assembly according to claim 1, wherein an upper end surface of the first block rib is in contact with a lower surface of the dispenser.

6. The dispenser assembly according to claim 1, wherein the dispenser comprises a siphon inlet, and the waterproof box comprises a second rib configured to face to the siphon inlet.

7. The dispenser assembly according to claim 6, wherein the second block rib is an arc-shaped structure, and the arc-shaped structure is convex toward the first block rib.

8. The dispenser assembly according to claim 1, wherein a bottom of the waterproof box is obliquely disposed relative to a horizontal plane, and a first end of the bottom of the waterproof box adjacent to the handle is higher than a second end of the bottom of the waterproof box facing away from the handle.

9. The dispenser assembly according to claim 8, wherein an included angle between the horizontal plane and the bottom of the waterproof box is within a range from 1° to 2.5°.

* * * * *